US005259789A

United States Patent [19]

Patel et al.

[11] Patent Number: 5,259,789

[45] Date of Patent: Nov. 9, 1993

[54] RETENTION SYSTEM FOR CIRCUIT BOARD MOUNTED ELECTRICAL CONNECTOR

[75] Inventors: Arvind Patel, Naperville; Jack J. Schafer, LaGrange, both of Ill.

[73] Assignee: Molex Incorporated, Lisle, Ill.

[21] Appl. No.: 21,405

[22] Filed: Feb. 23, 1993

[51] Int. Cl.[5] ..... H01R 13/73

[52] U.S. Cl. ..... 439/570; 439/83

[58] Field of Search ..... 439/83, 570, 571, 876

[56] References Cited

U.S. PATENT DOCUMENTS

| | | | |
|---|---|---|---|
| 5,096,440 | 3/1992 | Katsumata | 439/570 |
| 5,120,256 | 6/1992 | Walden | 439/553 |
| 5,133,670 | 7/1992 | Doi et al. | 439/79 |
| 5,145,405 | 9/1992 | Akiyama | 439/525 |
| 5,186,654 | 2/1993 | Enomoto et al. | 439/570 |

OTHER PUBLICATIONS

Molex Full Line Catalog #910, Part No. 52103,. p. 3G (Spring 91).

*Primary Examiner*—Gary F. Paumen

*Attorney, Agent, or Firm*—Stephen Z. Weiss

[57] ABSTRACT

A retention system is provided for an electrical connector adapted to be mounted on the surface of a printed circuit board. The connector includes a housing having a circuit board mounting face. At least one retention member is provided for securing the connector to the printed circuit board. The retention member is generally U-shaped defining a pair of leg sections extending generally perpendicular to the circuit board and a bight section joining the leg sections generally parallel to the circuit board. The bight section defines a pad for solder connection to a solder pad on the circuit board, and the bight section has a given width transverse to the U-shaped profile of the retention member. A recess in the circuit board mounting face of the connector housing is complementarily shaped for receiving at least one of the leg sections of the retention member in an interference fit therewith. The one leg section is narrower than the given width of the bight section. At least one stabilizing flange projects from the bight section into a complementarily shaped recess in the circuit board mounting face. The stabilizing flange is coplanar with, narrower and shorter than the one leg section.

6 Claims, 2 Drawing Sheets

RETENTION SYSTEM FOR CIRCUIT BOARD MOUNTED ELECTRICAL CONNECTOR

FIELD OF THE INVENTION

This invention generally relates to the art of electrical connectors and, particularly, to a retention system for an electrical connector adapted to be mounted on the surface of a printed circuit board.

BACKGROUND OF THE INVENTION

Electrical connectors which are adapted for mounting to printing circuit boards typically have a plurality of terminals for electrically engaging respective circuit traces on the surface of the board. The electrical engagement most commonly is effected by one of two systems. First, the terminals may have pin portions projecting from the connector for insertion into plated-through holes in the board wherein conductive plating material on the inside walls of the holes make electrical connection to circuit traces on the board surface. Second, the terminals may have leg portions extending generally parallel to the board surface and into engagement with the solder traces on the board surface. In both systems, the electrical engagement commonly is effected by soldering the pin portions to the circuit traces or the plating material in the holes in the board, or the leg portions to the circuit traces on the surface of the board.

In contemporary surface mount techniques, the individual terminals of the surface mount connector are connected to reflow solder pads of the circuit traces on the surface of the board. Increasing miniaturization and complexity of integrated circuit devices necessitates that the terminals be both relatively thin and closely spaced, with the resulting fragility requiring that the connector housing, itself, also be secured to the circuit board to afford strain relief for the terminal electrical engagements. A common type of strain relief has been provided for many years by mounting pegs or "boardlocks" which project from the connector housing into mounting or locking holes in the printed circuit board. However, with the increasing miniaturization and complexity of integrated circuit devices, such boardlocks consume valuable "real estate" on the circuit board. In addition, if electronic devices are to be mounted on both opposite sides of the board, mounting pegs or boardlocks cannot project through the board to the opposite side of the board where they will interfere with other electronic devices. Consequently, it is becoming common practice to secure such connectors on the surface of a printed circuit board by using a metal retaining device having a first portion anchored to the connector housing and a second, soldering portion attached to a dummy pad on the circuit board by reflow soldering. This invention is directed to improvements in such retaining devices which, themselves, are surface mounted to the printed circuit board.

SUMMARY OF THE INVENTION

An object, therefore, of the invention is to provide a new and improved retention system for an electrical connector adapted to be mounted on the surface of a printed circuit board.

In the exemplary embodiment of the invention, the connector includes a housing having a circuit board mounting face. At least one retention member is provided for securing the connector to the printed circuit board. The retention member is generally U-shaped defining a pair of leg sections extending generally perpendicular to the printed circuit board and a bight section joining the leg sections generally parallel to the printed circuit board. The bight section defines a pad for solder connection to a solder pad on the circuit board. The bight section has a given width transverse to the U-shaped profile of the retention member. Recess means are provided in the circuit board mounting face of the connector housing complementarily shaped for receiving at least one of the leg sections of the retention member in an interference fit therewith.

According to one aspect of the invention, the one leg section is narrower than the given width of the bight section, and at least one stabilizing flange projects from the bight section into a complementarily shaped recess in the circuit board mounting face. The stabilizing flange is coplanar with, narrower and shorter than the one leg section. In the preferred embodiment of the invention, a pair of the stabilizing flanges are respectively located on opposite side of the one leg section.

According to another aspect of the invention, the other leg section on the opposite side or edge of the bight section is narrower and shorter than the one leg section. A recessed area is provided in the circuit board mounting face into which the other leg section extends.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
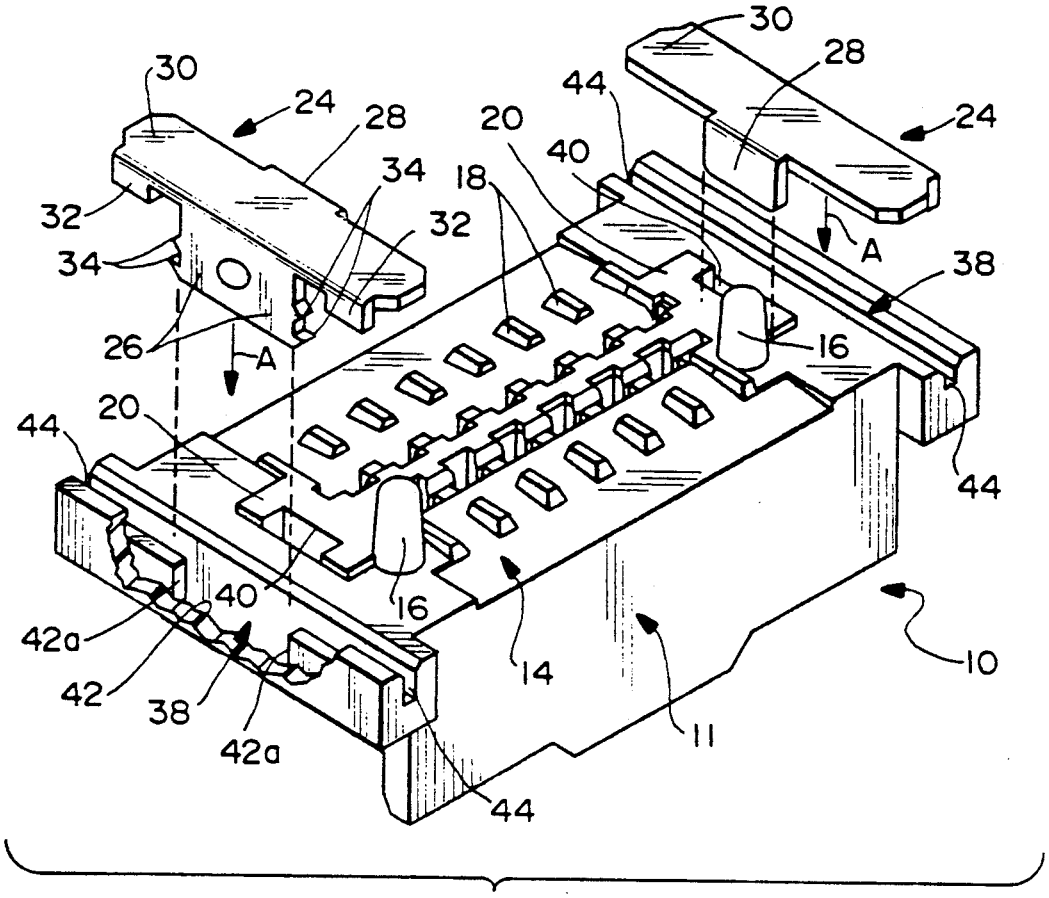
FIG. 1 is a perspective view of the board mounting side of an electrical connector embodying the retention system of the invention.
Figure 5:
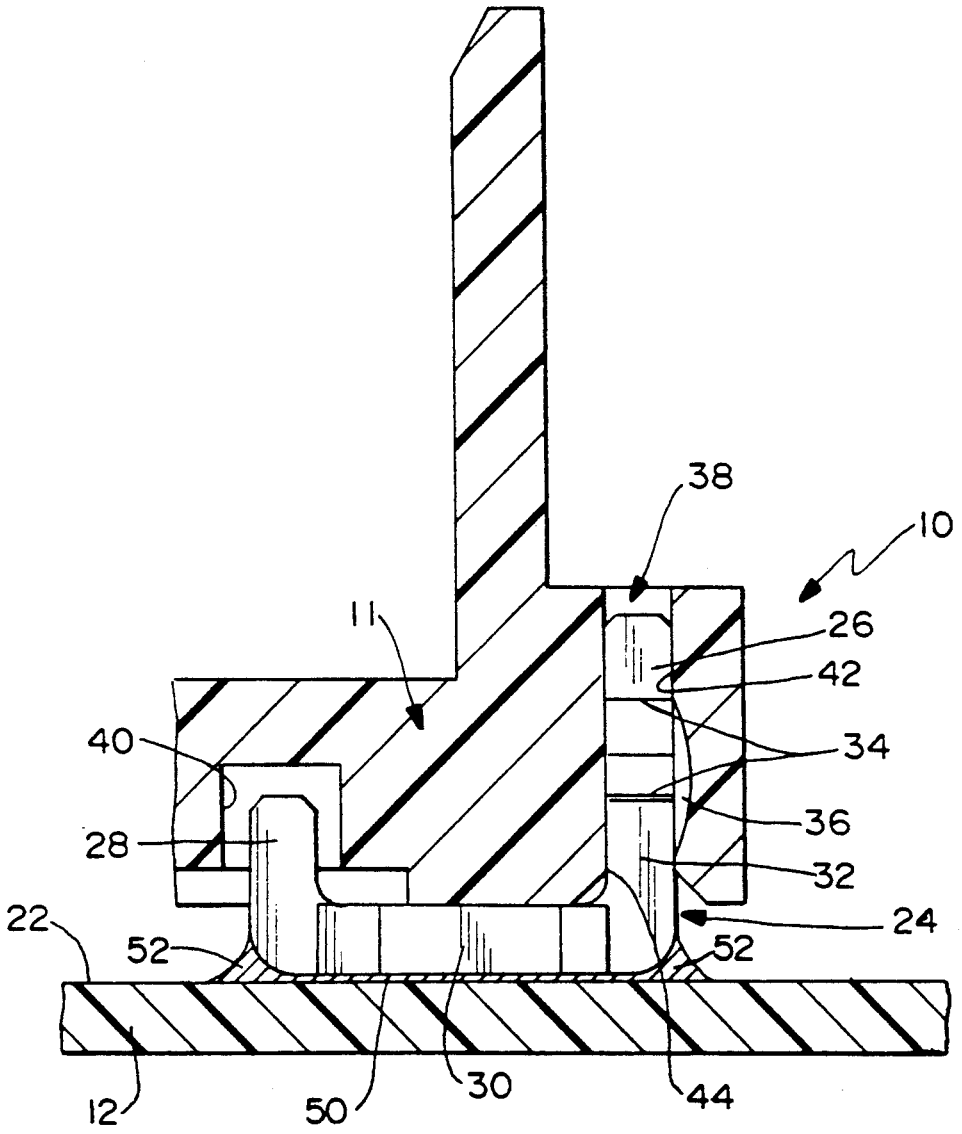
FIG. 5 is a section through the electrical connector in the area of mounting one of the retention members, with the retention member being soldered to a printed circuit board.

Referring to the drawings in greater detail, and first to FIG. 1, the invention is embodied in a retention system for an electrical connector, generally designated 10, which is adapted to be mounted on the surface of a printed circuit board 12 (FIG. 5). The connector includes a dielectric housing, generally designated 11, which has a circuit board mounting face, generally designated 14. A pair of mounting pegs 16 project from face 14 for location in a pair of complementarily shaped mounting holes in the printed circuit board. A plurality of standoffs 18 and raised surface areas 20 space housing 11 from a mounting surface 22 (FIG. 5) of printed circuit board 12. The retention system of the invention contemplates the employment of a pair of specifically designed retention members, generally designated 24, for securing connector 10 to printed circuit board 12.

Figure 4:
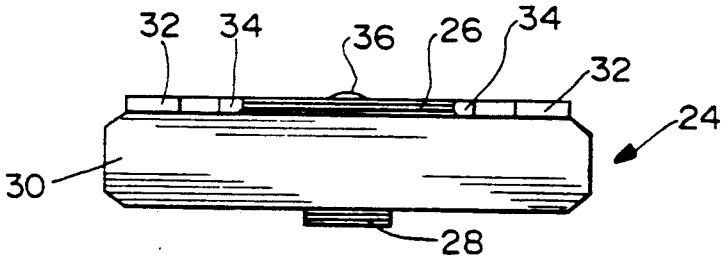
FIG. 4 is a top plan view of the retention member as viewed in FIGS. 2 and 3.
Figure 2:
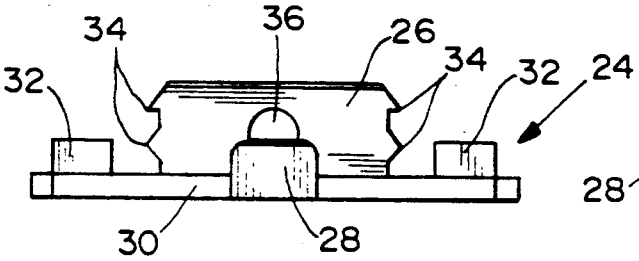
FIG. 2 is a side elevational view of one of the retention members.
Figure 3:
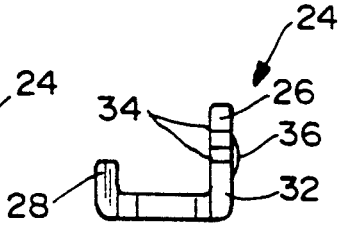
FIG. 3 is an end elevational view of the retention member as viewed in FIG. 2.

More particularly, referring to FIGS. 2–4 in conjunction with Figure each retention member 24 is generally U-shaped, as best seen in FIG. 3, defining a pair of leg sections 26 and 28 which, in use, extend generally perpendicular to the printed circuit board, along with a bight section 30 joining the leg sections generally parallel to the printed circuit board. The bight section defines a pad for solder connection to an appropriate dummy solder pad on the printed circuit board. The bight section has a given width transverse to the U-shaped profile of the retention member, i.e. the width is the left-to-right dimension in FIGS. 2 and 4.

As seen best in FIG. 2, leg section 26 is considerably narrower than bight section 30 and leg section 28, in turn, is considerably narrower than leg section 26. In addition, a pair of stabilizing flanges 32 project from the same side or edge of bight portion 30 as does leg section 26. The stabilizing flanges 32 are located adjacent opposite sides of leg section 26 and are generally coplanar therewith.

Lastly, leg section 26 includes barbs 34 projecting from the side edges thereof, along with a dimple 36 formed out of the plane of the leg section. The barbs skive into housing 11 which may be fabricated of molded plastic material, and dimple 36 establishes a firm engagement with the housing, all of which will be more apparent hereinafter, to securely mount the retention members to connector 10.

With the above detailed description of retention members 24, reference is made back to FIG. 1. The retention members are secured to housing in the direction of arrows "A", whereupon leg sections 26 will enter a recess means, generally designated 38, at opposite ends of the housing, and leg section 28 will enter a recess area 40. Each recess means 38 includes a central recess passage 42 for receiving leg 26 of the respective retention member, and a pair of recess troughs 44 for receiving stabilizing flanges 32. Each recess passage 42 has a width such that barbs 34 of leg 26 of the respective retention member skives into edges 42*a* of the recess passage.

Reference now is made to FIG. 5 wherein one of the retention members 24 is shown fully retained with housing 11 of connector 10 for securing the connector to printed circuit board 12. It can be seen that leg section 26 is tightly fit within recess passage 42 of recess means 38 as are stabilizing flanges 32 in recess troughs 44. On the other hand, leg 28 is shown simply extending into recess area 40, whereby the recess area accommodates leg 26 so that the entire retention member is positioned beneath the connector housing rather than projecting outwardly thereof.

The purposes for the specific design of each retention member 24 can best be understood by the solder means illustrated in FIG. 5. Specifically, the retention member is soldered to an appropriate solder pad on surface 22 of printed circuit board 12 by a solder layer 50 disposed between bight section 30 of the retention member and the dummy pad on the board. In addition, enlarged solder fillets 52 are created during the soldering process at the periphery of the bight section particularly in the areas of leg sections 26 and 28 and stabilizing flanges 32. Therefore, looking at retention member 24 in FIG. 2, it can be seen that either the leg sections or the stabilizing flanges are located at positions to cover substantially the entire length of bight section 30, with minor spacings between leg section 26 and the stabilizing flanges. This provides significant areas for enlarged solder fillets. This also provides rigidity for the planar bight portion along substantially its entire width. Of course, it can be understood that bight section 30 could be substantially reinforced by having leg section 26 extending the entire width thereof. However, this would be undesirable in most connectors because the provision of recess means to accommodate such a large securing leg section would considerably weaken the housing of the connector. It should be understood that such connectors may be extremely small or miniaturized.

In addition, the design of each retention member 24 is such as to maintain bight section 30 as flat or coplanar as possible. Again, with connector 10 being of an extremely miniaturized component, bight section 30 may be required to have a coplanarity within 0.004–0.006 inch, i.e. the thickness of solder area 50 in FIG. 5. Therefore, again referring to FIG. 2, it can be seen that, while leg 28 and stabilizing flanges 32 are not as wide or long as securing leg 26, these legs or flanges provide stability and rigidity for bight section 30 to maintain the coplanarity of the bight section within close tolerances to afford a good solder connection with surface 22 of printed circuit board 12.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a retention system for an electrical connector adapted to be mounted on the surface of a printed circuit board, including a connector housing having a circuit board mounting face, at least one retention member for securing the connector to the printed circuit board, the retention member being generally U-shaped defining a pair of leg sections extending generally perpendicular to the printed circuit board and a bight section joining the leg sections generally parallel to the printed circuit board, the bight section defining a pad for solder connection to a solder pad on the circuit board, the bight section having a given width transverse to the U-shaped profile of the retention member, and recess means in the circuit board mounting face of the connector housing complementarily shaped for receiving at least one of the leg sections of the retention member in an interference fit therewith, wherein the improvement comprises said at least one leg section being narrower than said given width of the bight section, and including at least one stabilizing flange projecting from the bight section into a complementarily shaped recess in the circuit board mounting face, the stabilizing flange being coplanar with, narrower and shorter than said at least one leg section.

2. In a retention system as set forth in claim 1, including a pair of said stabilizing flanges respectively located on opposite sides of said at least one leg section.

3. In a retention system as set forth in claim 1, including a recess area in the circuit board mounting face into which the other of said leg sections extend.

4. In a retention system as set forth in claim 3, wherein said other of the leg sections is narrower and shorter than said one leg section.

5. In a retention system as set forth in claim 1, wherein said at least one leg section includes barb means for skiving into the connector housing within said recess means to establish said interference fit.

6. A retention system for an electrical connector adapted to be mounted on the surface of a printed circuit board, comprising:

a dielectric connector housing having a circuit board mounting face;

at least one retention member for securing the connector to the printed circuit board, the retention member being generally U-shaped defining a pair of leg sections extending generally perpendicular to the printed circuit board and a bight section joining the leg sections generally parallel to the printed circuit board, the bight section defining a pad for solder connection to a solder pad on the printed circuit board, and the bight section having a given width transverse to the U-shaped profile of the retention member, one of the leg sections being narrower than the given width of the bight section, the other leg section being narrower and shorter than the one leg section, a pair of stabilizing flanges respectively located on opposite sides of the one leg section, the stabilizing flanges being coplanar with the one leg section and each stabilizing flange being narrower and shorter than the one leg section, and the connector housing including recess means in the circuit board mounting face for receiving the one leg section and the stabilizing flanges and including a recess passage complementarily shaped for receiving the one leg section in an interference fit, and a recess area for accommodating the other leg section.

* * * * *